US011111757B2

(12) United States Patent
Stamm et al.

(10) Patent No.: US 11,111,757 B2
(45) Date of Patent: Sep. 7, 2021

(54) SYSTEM AND METHODOLOGY FOR CONTROLLING FLUID FLOW

(71) Applicant: SCHLUMBERGER TECHNOLOGY CORPORATION, Sugar Land, TX (US)

(72) Inventors: Bryan Stamm, Houston, TX (US); Michael Dean Langlais, Houston, TX (US); John R. Whitsitt, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 67 days.

(21) Appl. No.: 16/494,734

(22) PCT Filed: Mar. 16, 2018

(86) PCT No.: PCT/US2018/022773
§ 371 (c)(1),
(2) Date: Sep. 16, 2019

(87) PCT Pub. No.: WO2018/170345
PCT Pub. Date: Sep. 20, 2018

(65) Prior Publication Data

US 2020/0011155 A1 Jan. 9, 2020

Related U.S. Application Data

(60) Provisional application No. 62/472,459, filed on Mar. 16, 2017.

(51) Int. Cl.
*E21B 43/04* (2006.01)
*E21B 43/08* (2006.01)
(Continued)

(52) U.S. Cl.
CPC ..... *E21B 34/10* (2013.01); *E21B 34/066* (2013.01); *E21B 43/045* (2013.01); *E21B 43/086* (2013.01)

(58) Field of Classification Search
CPC ..... E21B 43/04; E21B 43/0415; E21B 43/08
See application file for complete search history.

(56) References Cited

U.S. PATENT DOCUMENTS 6,333,699 B1 12/2001 Zierolf
6,333,700 B1 12/2001 Thomeer et al.
(Continued)

FOREIGN PATENT DOCUMENTS

SU 1479627 A1 5/1989
WO 2009098512 A2 8/2009
(Continued)

OTHER PUBLICATIONS

International Search Report and Written Opinion of PCT Application No. PCT/US2018/022773 dated Jun. 27, 2018, 14 pages.
(Continued)

*Primary Examiner* — Giovanna Wright
(74) *Attorney, Agent, or Firm* — Kelly McKinney; Michael Dae

(57) ABSTRACT

A technique facilitates formation of a gravel pack. A well completion is provided to facilitate improved gravel packing during a gravel packing operation and subsequent production. The well completion is constructed to freely return a gravel pack carrier fluid through a base pipe during gravel packing. A valve system is positioned to enable restriction of fluid flow into the base pipe following the gravel packing operation. The valve system may be selectively actuated to restrict the fluid flow into the base pipe via a signal such as a pressure signal or timed electric signal.

16 Claims, 12 Drawing Sheets

(51) Int. Cl.
*E21B 34/10* (2006.01)
*E21B 34/06* (2006.01)

(56) References Cited

U.S. PATENT DOCUMENTS

| | | | | |
|---|---|---|---|---|
| 6,536,524 | B1 | 3/2003 | Snider | |
| 6,759,968 | B2 | 7/2004 | Zierolf | |
| 6,915,848 | B2 | 7/2005 | Thomeer et al. | |
| 6,989,764 | B2 | 1/2006 | Thomeer et al. | |
| 7,014,100 | B2 | 3/2006 | Zierolf | |
| 7,063,148 | B2 | 6/2006 | Jabusch | |
| 7,283,061 | B1 | 10/2007 | Snider et al. | |
| 7,385,523 | B2 | 6/2008 | Thomeer et al. | |
| 7,400,263 | B2 | 7/2008 | Snider et al. | |
| 7,677,439 | B2 | 3/2010 | Zierolf | |
| 7,708,068 | B2 | 5/2010 | Hailey, Jr. | |
| 7,714,741 | B2 | 5/2010 | Snider et al. | |
| 7,971,642 | B2 | 7/2011 | Yeh et al. | |
| 7,984,760 | B2 | 7/2011 | Haeberle et al. | |
| 8,044,820 | B2 | 10/2011 | Snider et al. | |
| 8,091,775 | B2 | 1/2012 | Zierolf | |
| 8,127,831 | B2 | 3/2012 | Haeberle et al. | |
| 9,140,818 | B2 | 9/2015 | Zierolf | |
| 9,771,780 | B2 | 9/2017 | Langlais | |
| 2004/0144544 | A1 | 7/2004 | Freyer | |
| 2008/0053658 | A1 | 3/2008 | Wesson et al. | |
| 2008/0283238 | A1 | 11/2008 | Richards et al. | |
| 2008/0283252 | A1* | 11/2008 | Guignard | E21B 33/124 166/381 |
| 2009/0008078 | A1* | 1/2009 | Patel | E21B 41/0035 166/50 |
| 2009/0008092 | A1 | 1/2009 | Haeberle et al. | |
| 2009/0101341 | A1 | 4/2009 | Willauer | |
| 2010/0013664 | A1 | 1/2010 | Zierolf | |
| 2011/0073308 | A1* | 3/2011 | Assal | E21B 43/08 166/278 |
| 2011/0162840 | A1 | 7/2011 | Haeberle et al. | |
| 2011/0199228 | A1 | 8/2011 | Roddy et al. | |
| 2013/0228341 | A1 | 9/2013 | Fripp et al. | |
| 2014/0020898 | A1* | 1/2014 | Holderman | E21B 43/08 166/304 |
| 2015/0027700 | A1 | 1/2015 | Riisem et al. | |
| 2015/0034311 | A1 | 2/2015 | Tunget | |
| 2015/0308238 | A1 | 10/2015 | Langlais | |

FOREIGN PATENT DOCUMENTS

| | | | |
|---|---|---|---|
| WO | 2012082304 | A2 | 6/2012 |
| WO | 2020185655 | A1 | 9/2020 |

OTHER PUBLICATIONS

International Preliminary Report on Patentability of PCT Application No. PCT/US2018/022773 dated Sep. 26, 2019, 12 pages.
Office Action received in Russian Patent Application No. 2019132603 dated Mar. 30, 2021, 14 pages with English Translation.
International Search Report and Written Opinion of PCT Application No. PCT/US2020/021658 dated Jul. 2, 2020, 14 pages.

* cited by examiner

SYSTEM AND METHODOLOGY FOR CONTROLLING FLUID FLOW

CROSS-REFERENCE TO RELATED APPLICATION

The present document is based on and claims priority to U.S. Provisional Application Ser. No. 62/472,459, filed Mar. 16, 2017, which is incorporated herein by reference in its entirety.

BACKGROUND

Gravel packs are used in wells for removing particulates from inflowing hydrocarbon fluids. In a variety of applications gravel packing is performed in long horizontal wells by pumping gravel suspended in a carrier fluid down the annulus between the wellbore and a screen assembly. The carrier fluid is returned to the surface after depositing the gravel in the wellbore annulus. To return to the surface, the carrier fluid flows through the screen assembly, through base pipe perforations, and into a production tubing which routes the returning carrier fluid back to the surface. Additionally, some applications utilize alternate path systems having various types of shunt tubes which help distribute the gravel slurry. In some applications, inflow control devices have been combined with screen assemblies to provide control over the subsequent inflow of production fluids. However, the combination of inflow control devices and alternate path systems provide technical complications regarding flow of the returning carrier fluid back into the production tubing.

SUMMARY

In general, a system and methodology are provided for facilitating formation of a gravel pack and subsequent production. A well completion is provided to facilitate improved gravel packing during a gravel packing operation and subsequent production through an inflow control device (ICD). The well completion is constructed to freely return a gravel pack carrier fluid through a base pipe during gravel packing. A valve system is positioned to enable restriction of fluid flow into the base pipe following the gravel packing operation. The valve system is readily actuated to restrict the fluid flow into the base pipe via a signal, e.g. a pressure signal or a timed electrical signal.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
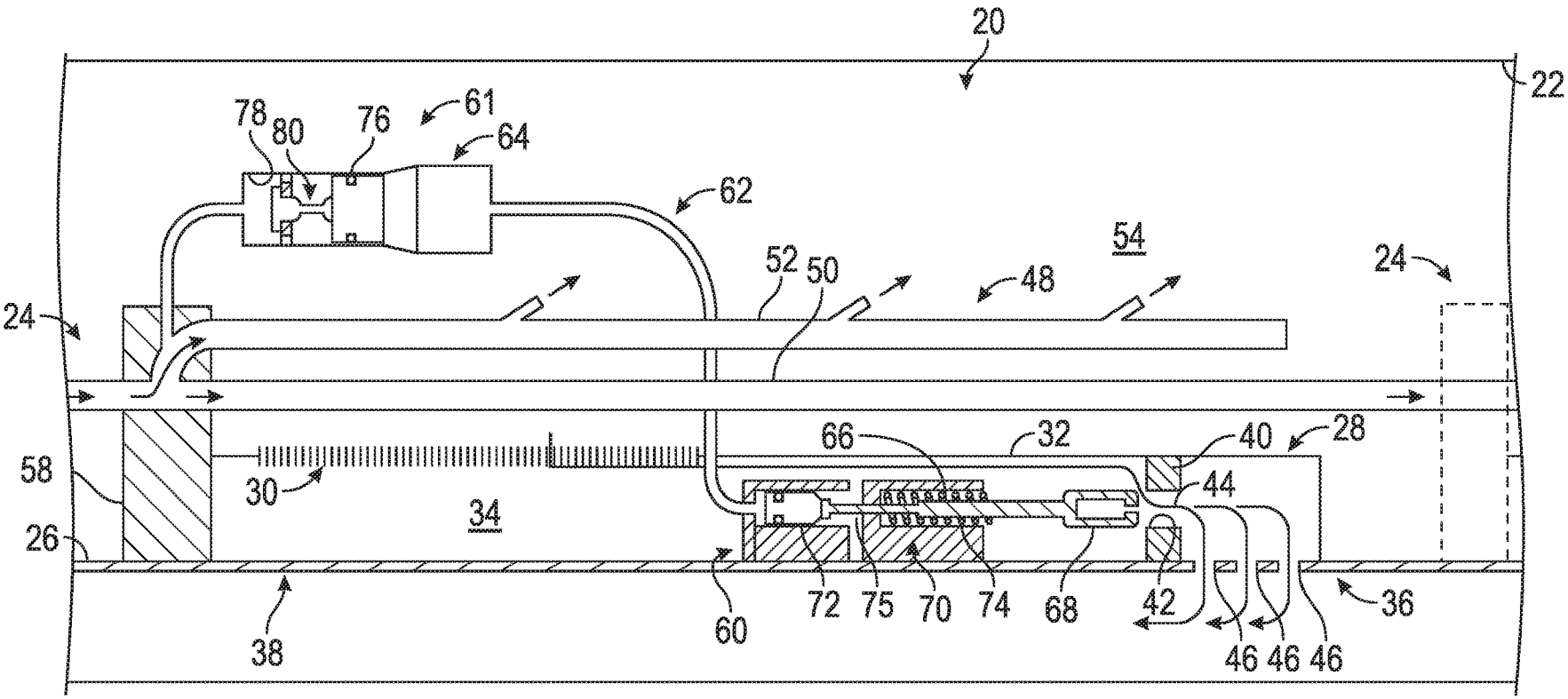
FIG. 1 is a schematic illustration of an example of a completion system deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology useful for controlling fluid flow. The system and methodology may be used, for example, to facilitate formation of gravel packs in wellbores and subsequent production of well fluids. The well completion system is constructed to freely return a gravel pack carrier fluid through a base pipe of the completion system during gravel packing. A valve system is positioned to enable restriction of fluid flow into the base pipe following the gravel packing operation. For example, the valve system may be used to convert the completion system from allowing free-flowing return of carrier fluids to restricted flow through an inflow control device. The valve system actuates in response to a predetermined signal to restrict the fluid flow into the base pipe.

In some embodiments, the well completion is provided with a shunt tube system for carrying gravel slurry along an alternate path so as to facilitate improved gravel packing during a gravel packing operation. For example, the valve system may be operatively coupled with the shunt tube system and selectively actuated to restrict the fluid flow into the base pipe via a pressure signal applied in the shunt tube system. In other embodiments, however, the signal may be in the form of a timed electric signal or other suitable signal. However, pressure signals, timed electric signals, or other suitable signals may be used with a variety of well completions, including well completions which do not employ the alternate path type shunt tube systems.

Inflow control devices (ICDs) have been used in completion systems having screen assemblies deployed along, for example, horizontal wells. ICDs enable production maximization throughout longer wells by restricting production from the heel of the well and from high permeability zones, thus allowing flow contribution in hard-to-reach regions of the well, e.g. regions at the toe of the well and lower permeability zones. In various applications, gravel packs are formed along the screen assemblies of the completion system to help filter sand from the inflowing well fluid. Shunt tube systems can be used to provide alternate paths for the gravel slurry during the gravel packing operation to ensure a more uniform gravel pack. The completion systems described herein use valve assemblies controlled by signals, e.g. pressure signals provided via the shunt tube system. The valve assemblies may be selectively actuated between a flow position enabling a freer flow of returning gravel slurry carrier fluid and a subsequent flow position restricting flow. For example, the subsequent flow position may restrict flow of fluid during production to flow through ICDs at desired well zones.

Because gravel packing operations often take place at significant flow rates through the shunt tube system, return of the carrier fluid at this rate involves providing relatively large flow areas through the base pipe wall. This allows the returning carrier fluid to flow into an interior of the base pipe for return to the surface. The ICDs used in many types of production operations, however, do not enable a desirable level of flow with respect to directing the carrier fluid to an interior of the base pipe. In embodiments described herein, a valve assembly is used in a screen assembly of the completion system to enable increased flow of carrier fluid into the base pipe during the gravel packing operation. However, the valve assembly may be actuated via a signal, e.g. pressure signals or timed electric signals, to restrict the inflow of fluid to a desired ICD level flow during subsequent production of well fluids. In some embodiments, multiple valve assemblies may be used in multiple corresponding screen assemblies disposed along the completion system.

According to an embodiment, the completion system utilizes at least one valve assembly having a valve member shiftable between operational positions. By way of example, the valve member may comprise a gravel pack-to-ICD transition dart shiftable between operational positions. In some embodiments, a pressure signal applied through the shunt tube system may be used to trigger actuation of the transition dart in the valve assembly. For example, a screen-out shunt tube pressure within the alternate path system transport tubes may be used to trigger the transition dart or darts from a free flow position to a restricted (ICD) flow position.

In various gravel packing operations, a screen-out pressure spike occurs at completion of the gravel packing operation. This pressure spike may be utilized to activate transition of the valve assemblies from a gravel pack configuration to an ICD configuration. It should be noted that if valve assembly activation pressure settings are below friction pressures experienced while gravel packing at far distances downhole, then friction pressures may transition some valve assemblies during the gravel pack operation while the remaining valve assemblies activate upon experiencing the screen-out pressure spike. However, other types of pressure signals may be provided through the shunt tube system for actuation of the valve assembly or assemblies from one operational position to another. Additionally, other types of signals may be used to initiate actuation of the valve assembly, e.g. electric signals automatically initiated after a predetermined time period.

Referring generally to FIG. 1, an example of a completion system 20 is illustrated as deployed in a wellbore 22. In this example, completion system 20 comprises a screen assembly 24 having a base pipe 26 which may be formed by joining a plurality of base pipe joints. The completion system 20 may comprise a plurality of the screen assemblies 24 connected together sequentially.

As illustrated, each screen assembly 24 may comprise a tubular member 28 having a filter section 30 and a non-permeable section 32. The base pipe 26 is disposed within the tubular member 28 and creates an annulus 34 therebetween. In this embodiment, the base pipe 26 has a perforated base pipe section 36 generally radially inward of non-permeable section 32 and a non-perforated base pipe section 38 generally radially inward of filter section 30. A bulkhead 40 may extend between tubular member 28 and base pipe 26 at a location dividing the perforated base pipe section 36 from the non-perforated base pipe section 38. The bulkhead 40 comprises a passage 42, e.g. a plurality of passages 42, extending therethrough and of sufficient size to avoid substantial pressure loss as a clean carrier fluid 44 is returned during a gravel packing operation. As illustrated, the clean, gravel slurry carrier fluid 44 returns through filter section 30, flows along annulus 34, through passage(s) 42, through openings 46 of perforated base pipe section 36, and into the interior of base pipe 26 for return to a surface location.

Figure 2:
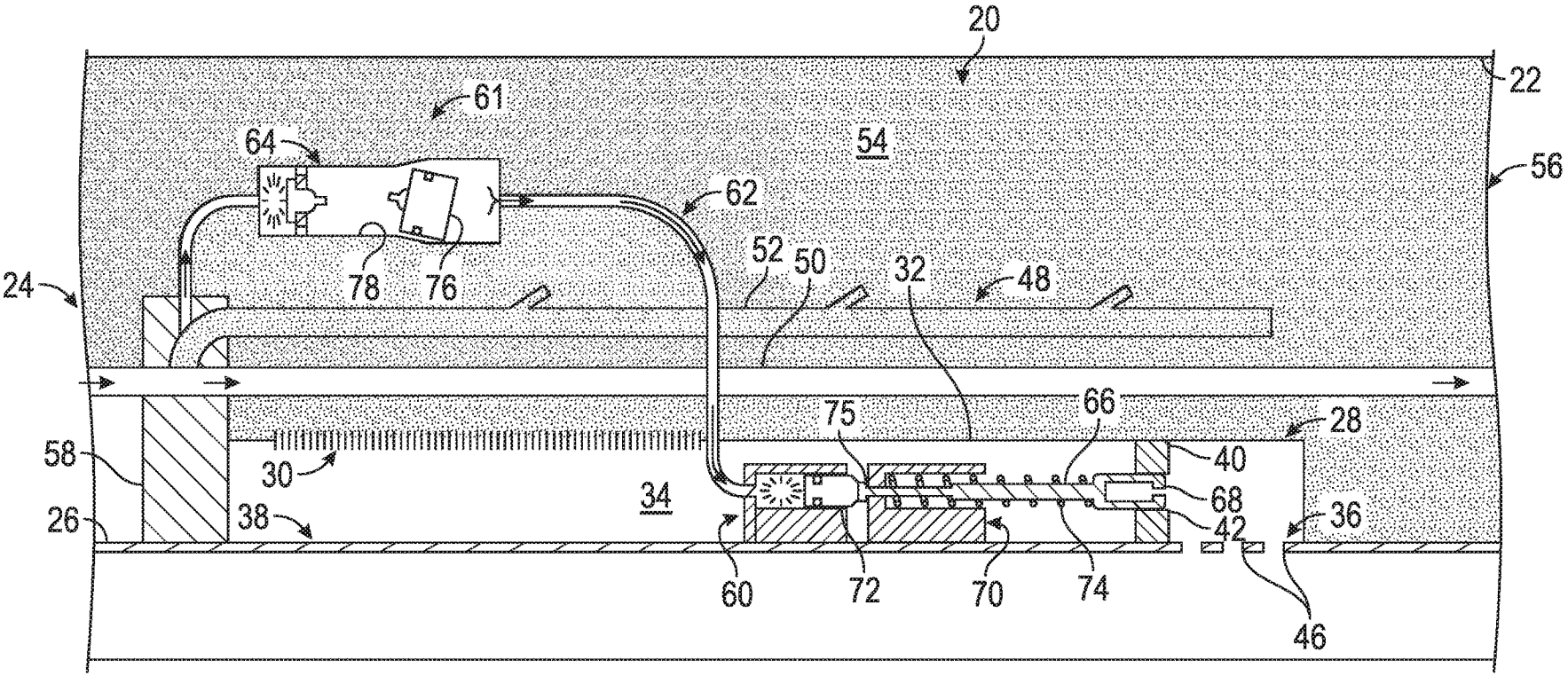
FIG. 2 is a schematic illustration similar to that of FIG. 1 but following a gravel packing operation, according to an embodiment of the disclosure.

In this embodiment, the screen assembly 24 further comprises an alternate path, shunt tube system 48 deployed externally of tubular member 28. The shunt tube system 48 may comprise a plurality of tubes for carrying and distributing gravel slurry during a gravel packing operation. For example, the shunt tube system 48 may comprise at least one transport tube 50 and at least one packing tube 52 used to transport and disperse the gravel slurry, respectively. For example, one or more packing tubes 52 may be used in each well zone 54 to distribute gravel slurry into the well zone 54. The carrier fluid 44 flows back into the base pipe 26 leaving a gravel pack 56, as illustrated in FIG. 2. The shunt tube system 48 also may comprise a manifold or manifolds 58 disposed along the base pipe 26 for fluidly connecting the transport tube 50 to the packing tubes 52.

Referring again to FIG. 1, the completion system 20 further comprises at least one valve assembly 60. By way of example, one or more valve assemblies 60 may be combined into each screen assembly 24 as illustrated. Each valve assembly 60 is positioned in cooperation with a corresponding passage 42. In some embodiments, a single valve assembly 60 may be positioned in cooperation with a single passage 42 while other embodiments may utilize a plurality of valve assemblies 60 positioned for cooperation with corresponding passages 42 in bulkhead 40. Each valve assembly 60 may be activated, e.g. triggered, via an actuator system 61, e.g. a pressure based actuator system, an electrical actuation system, and/or other suitable actuation system, actuatable to enable transmission of the valve assembly 60 between operational positions. The actuation system 61 actuates in response to a suitable signal which may be in the form of a pressure signal, a timed electrical signal, or another suitable signal.

In some embodiments, each valve assembly 60 may be coupled with a flow line 62 extending to the shunt tube system 48. By way of example, the flow line 62 may be placed into communication with the shunt tube system 48 in manifold 58. In some applications, the flow line 62 may be placed in communication with transport tube 50. In this type of embodiment, the valve assembly 60 is actuatable via a suitable pressure signal applied in the shunt tube system 48 and communicated to the valve assembly 60 via the flow line 62. By way of example, the actuation system 61 may comprise a pressure release mechanism 64. The pressure release mechanism 64 may be positioned along the flow line 62 to prevent communication of pressure along the flow line 62 until the desired pressure signal is applied to flow line 62 via shunt tube system 48.

According to an example, each valve assembly 60 may comprise a valve member 66 oriented for selective engagement with the corresponding passage 42 so as to limit flow through the bulkhead 40. The limitation of flow through bulkhead 40 also serves to limit the flow into base pipe 26 through perforated base pipe section 36 once the valve assembly 60 is triggered via a suitable pressure signal applied to shunt tube system 48 and flow line 62. In some embodiments, the valve member 66 is in the form of a dart. The valve member/dart 66 may comprise an ICD 68 which provides the desired flow into base pipe 26 once the valve assembly 60 is actuated. It should be noted the valve member/dart 66 also may comprise a plug; and the ICD 68 or ICDs 68 may be located along the wall forming base pipe 26 as described in greater detail below. By shifting the valve member/dart 66 during actuation of valve assembly 60, the corresponding screen assembly may be transitioned from gravel packing mode to production flow mode.

In the illustrated embodiment, the dart 66 is slidably mounted in a valve assembly structure 70. The dart 66 may be selectively released upon application of the appropriate pressure signal via shifting of, for example, a piston 72 into engagement with the dart 66 in a manner which releases the dart 66 for movement into engagement with the corresponding passage 42. In some embodiments, the dart 66 may be shifted via pressurized fluid delivered through flow line 62 and in other applications the dart 66 may be shifted via other suitable mechanisms, such as a spring 74. For example, the piston 72 may be moved into engagement with a spring release pin 75 which releases spring 74 so as to shift dart 66 and ICD 68 into engagement with corresponding passage 42. The spring release pin 75 may operate to release a catch, ball, or other feature holding dart 66 and/or spring 74 in a retracted position.

The pressure release mechanism 64 also may be constructed in various configurations. By way of example, the pressure release mechanism 64 may comprise a piston 76 sealably retained in a corresponding cylinder 78 by a retainer 80, e.g. a necked tension bolt, as illustrated in FIG. 1. It should be noted the pressure release mechanism 64 may comprise various other components to retain pressure until a desired pressure level is applied. Such components may include a rupture disc, an electric rupture disc (ERD), or other suitable devices which release upon application of a pressure level trigger or other suitable trigger, e.g. an electric signal. One embodiment of an ERD which is responsive to an electric signal is described below with reference to FIGS. 15 and 16.

Figure 3:
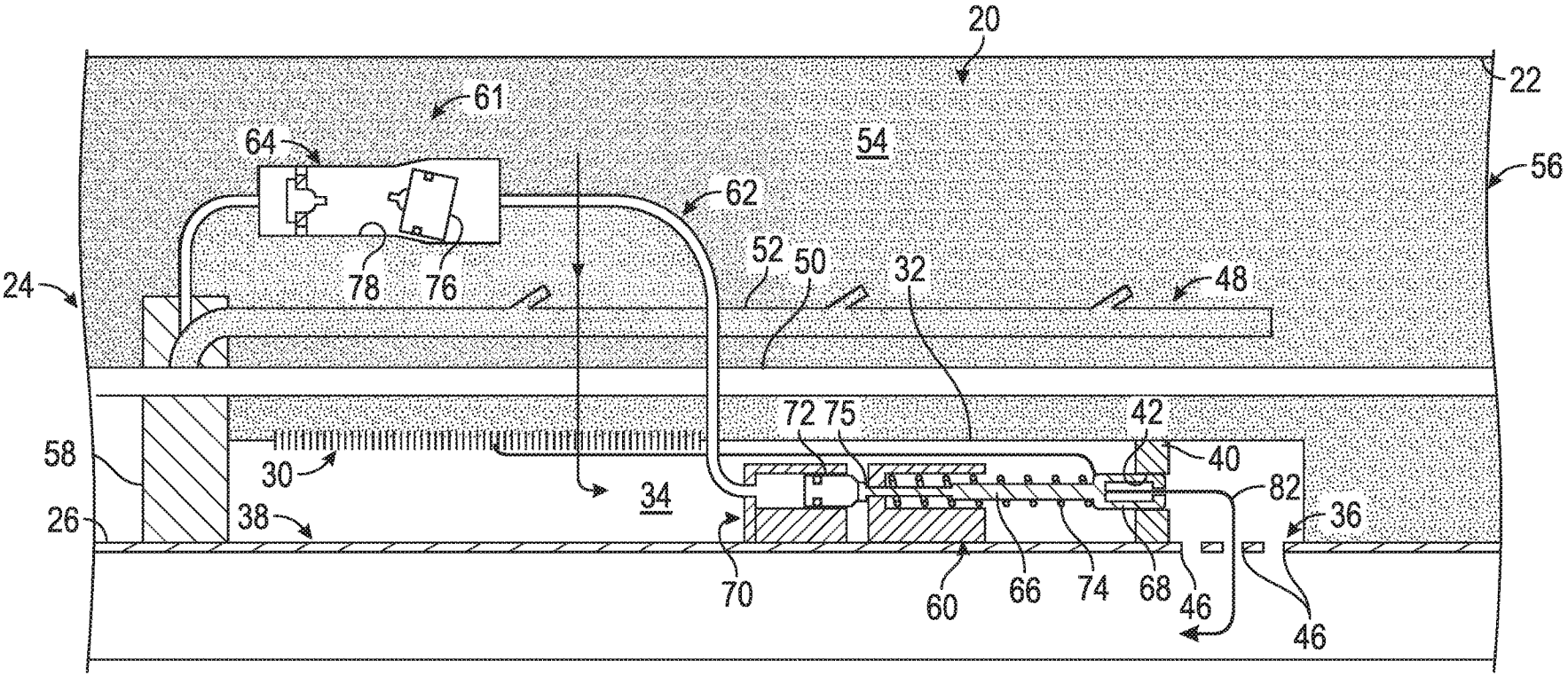
FIG. 3 is a schematic illustration similar to that of FIG. 2 following initiation of production flow, according to an embodiment of the disclosure.

Upon application of sufficient pressure in shunt tube system 48, the retainer 80 releases piston 76 from corresponding cylinder 78 so that fluid may flow through the pressure release mechanism 64 along flow line 62, as illustrated in FIG. 2. The pressure signal is communicated to the corresponding valve assembly 60 via flow line 62 and causes actuation of the valve assembly 60. In the illustrated embodiment, the dart 66 is released and shifted into engagement with the corresponding passage 42. In this example, the dart 66 comprises ICD 68 which allows a desired production flow 82 to flow through the ICD 68 and into base pipe 26, as illustrated in FIG. 3, when valve assembly 60 is in the restricted flow position.

Referring generally to FIGS. 4-11, embodiments of valve assembly 60 are illustrated and comprise a dart 66. By way of example, the dart 66 may be part of a dart cartridge and may include ICD 68 which is selectively moved into engagement with the corresponding passage 42. However, the dart 66 also may be formed with a plug (as described in greater detail below with reference to FIG. 17) which is moved to plug corresponding passage 42 and to thus force production flow through at least one ICD 68 positioned through the wall of base pipe 26.

Figure 4A:
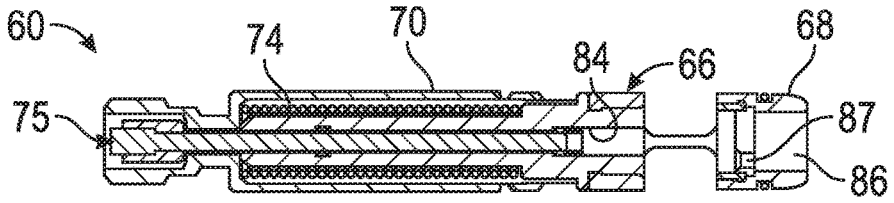
FIG. 4A is a cross-sectional illustration showing operation of a valve assembly operable to control fluid flow with respect to the completion system, according to an embodiment of the disclosure.
Figure 4B:
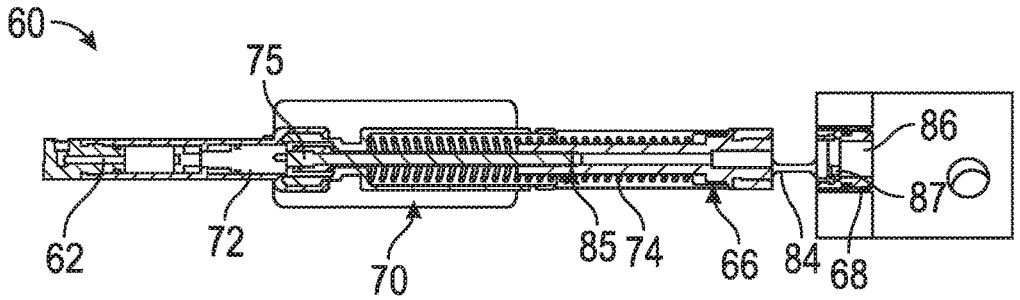
FIG. 4B is a cross-sectional illustration similar to that of FIG. 4A but showing the valve assembly in a different operational position, according to an embodiment of the disclosure.

In the embodiment illustrated in FIGS. 4A and 4B, the dart 66 is held in structure 70 via spring release pin 75 which extends along a passage 84, e.g. a bore, oriented longitudinally through dart 66. When the pressure signal is applied through flow line 62, piston 72 is moved into engagement with spring release pin 75 in a manner which releases the dart 66 and thus the spring 74. The spring 74 forces dart 66 to move linearly into engagement with corresponding passage 42 as illustrated in FIG. 4B. The extended spring release pin 75 and corresponding passage 84 cooperate to help guide ICD 68 into engagement with passage 42. Once the dart 66 is extended, the spring release pin 75 may be re-locked in position via a lock mechanism 85, e.g. a ball and pocket mechanism along passage 84. In this example, the ICD 68 may comprise one or more inflow control orifices or friction-inducing conduits 86 sized to enable the desired production flow after actuation of valve assembly 60. In some applications, each orifice 86 may be provided with a nozzle 87 formed of a suitably hard material.

Figure 5A:
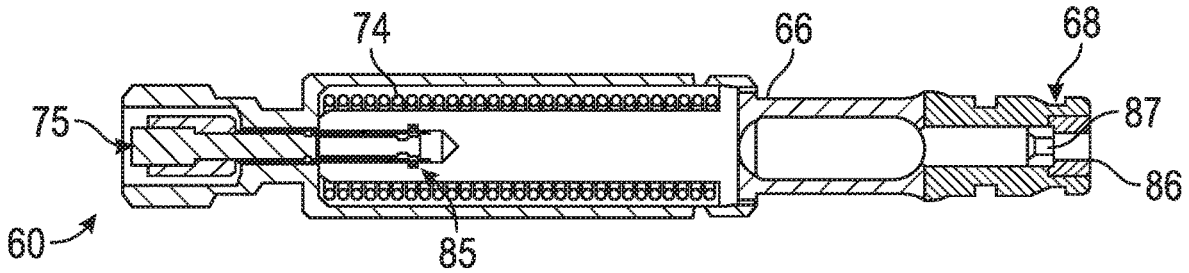
FIG. 5A is a cross-sectional illustration of another embodiment of the valve assembly, according to an embodiment of the disclosure.
Figure 5B:
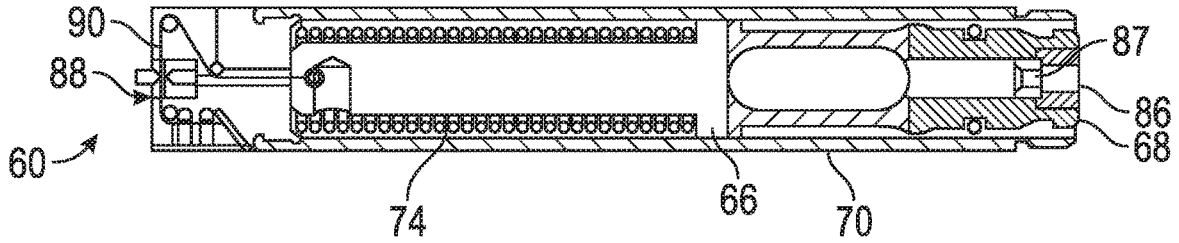
FIG. 5B is a cross-sectional illustration similar to that of FIG. 5A but showing the valve assembly in a different operational position, according to an embodiment of the disclosure.
Figure 6A:
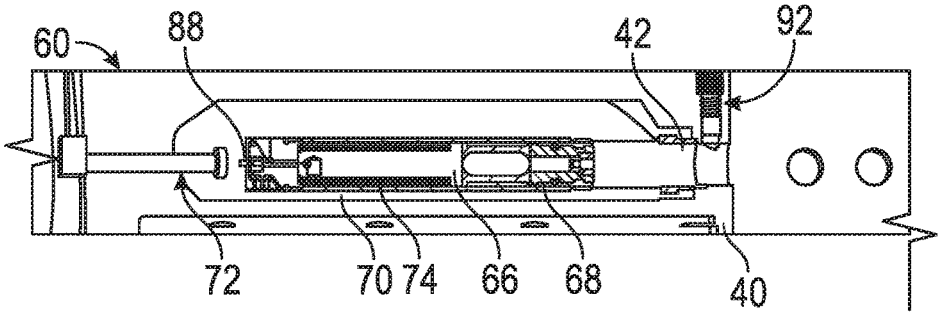
FIG. 6A is a cross-sectional illustration showing another embodiment of the valve assembly, according to an embodiment of the disclosure.
Figure 6B:
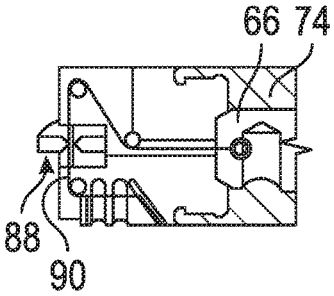
FIG. 6B is an enlarged illustration of an example of a cutter mechanism which may be used in the valve assembly illustrated in FIG. 6A, according to an embodiment of the disclosure.
Figure 6C:
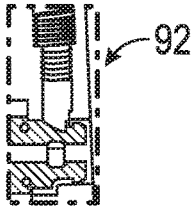
FIG. 6C is an enlarged illustration of an example of a locking mechanism which may be used in the valve assembly illustrated in FIG. 6A, according to an embodiment of the disclosure.
Figure 6D:
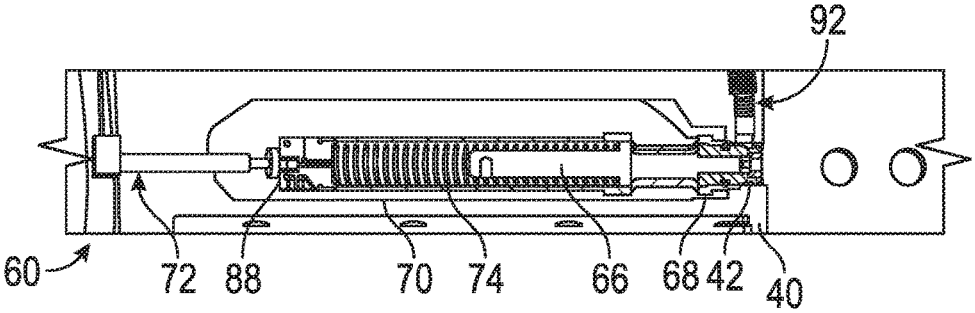
FIG. 6D is a cross-sectional illustration similar to that of FIG. 6A but showing the valve assembly in a different operational position, according to an embodiment of the disclosure.

In FIGS. 5A and 5B, other embodiments of mechanisms for selectively releasing dart 66 and spring 74 are illustrated. For example, the embodiment illustrated in FIG. 5A comprises spring release pin 75 but in a shorter form which does not utilize passage 84 extending through the entire dart 66. The embodiment illustrated in FIG. 5B utilizes a cutter mechanism 88. The cutter mechanism 88 may be actuated by piston 72 so as to cut a cord 90, e.g. wire or multi-fiber string, which releases dart 66 and spring 74, as illustrated in greater detail in FIGS. 6A-6D. As illustrated, the cord 90 is secured to dart 66 so as to hold spring 74 in a compressed state. Once cutter mechanism 88 is actuated via piston 72, the cord 90 is cut and dart 66 is released. At this stage, spring 74 shifts dart 66 linearly into engagement with corresponding passage 42. A ball and pocket lock mechanism, e.g. lock mechanism 85, may be used to secure the dart 66 in engagement with corresponding passage 42. However, additional and/or other types of locking mechanisms 92, e.g. a spring-loaded catch, may be used to secure the dart 66 in this engaged position, as further illustrated in FIGS. 6C and 6D.

Figure 7:
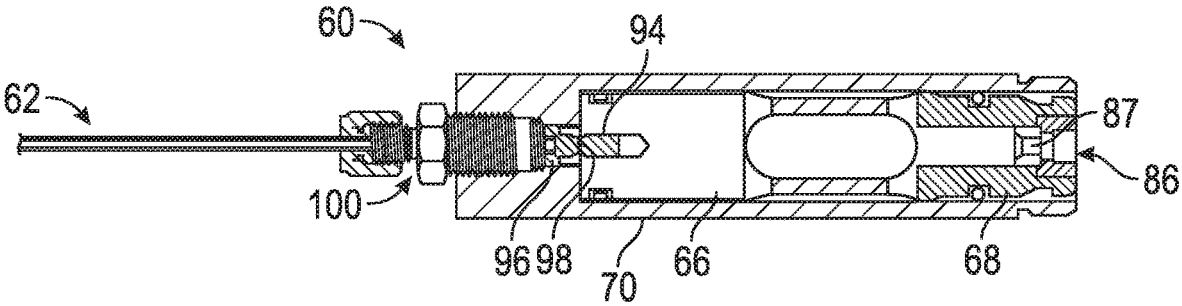
FIG. 7 is a cross-sectional illustration of another embodiment of the valve assembly, according to an embodiment of the disclosure.
Figure 8A:
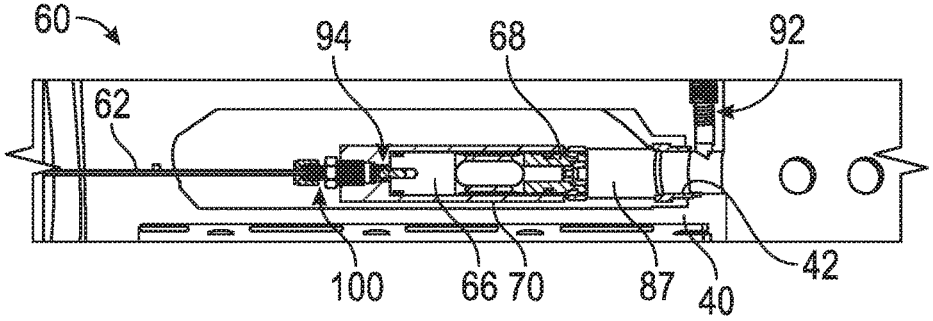
FIG. 8A is a cross-sectional illustration of another embodiment of the valve assembly, according to an embodiment of the disclosure.
Figure 8B:
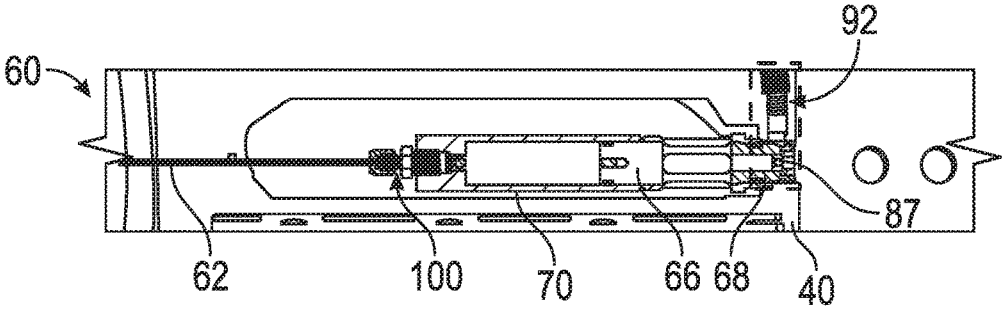
FIG. 8B is a cross-sectional illustration similar to that of FIG. 8A but showing the valve assembly in a different operational position, according to an embodiment of the disclosure.
Figure 8C:
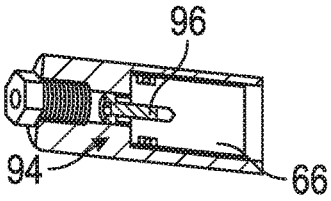
FIG. 8C is an enlarged illustration of an example of a retainer mechanism which may be used in the valve assembly illustrated in FIG. 8A, according to an embodiment of the disclosure.
Figure 8D:
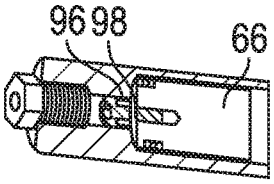
FIG. 8D is an illustration similar to that of FIG. 8C but after release of the retainer mechanism, according to an embodiment of the disclosure.

Referring generally to FIG. 7 and FIGS. 8A-8B, an embodiment of valve assembly 60 is illustrated in which fluid pressure is used to shift dart 66 rather than spring 74. In this example, the dart 66 is formed as a piston which seals with an interior surface of structure 70. The dart 66 may be held in a retracted position within structure 70, as illustrated in FIG. 7. By way of example, the dart 66 may be held within structure 70 by a dart retainer 94, e.g. a tension bolt 96 having a built in fracture region 98. The flow line 62 is placed in fluid communication with retainer 94 and dart 66 via a coupling 100 attached to structure 70. When the pressure signal, e.g. a sufficient pressure level, is provided through flow line 62, the retainer 94 is released, e.g. tension bolt 96 is fractured, and dart 66 is released, as further illustrated in FIGS. 8C and 8D. Pressurized fluid may be directed into structure 70 through flow line 62 on a back side of dart 66 so as to shift dart 66 linearly into engagement with the corresponding passage 42. Locking mechanism 92 may again be used to secure the dart 66 and ICD 68 in this engaged position.

Figure 9:
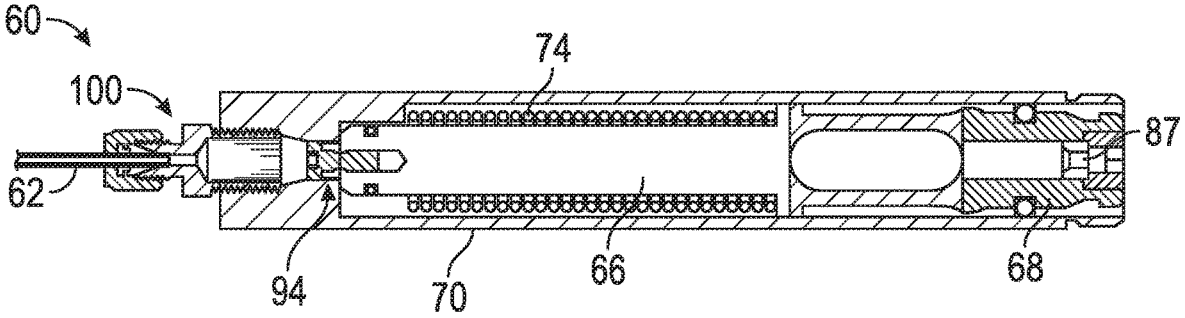
FIG. 9 is a cross-sectional illustration of another embodiment of the valve assembly, according to an embodiment of the disclosure.
Figure 10A:
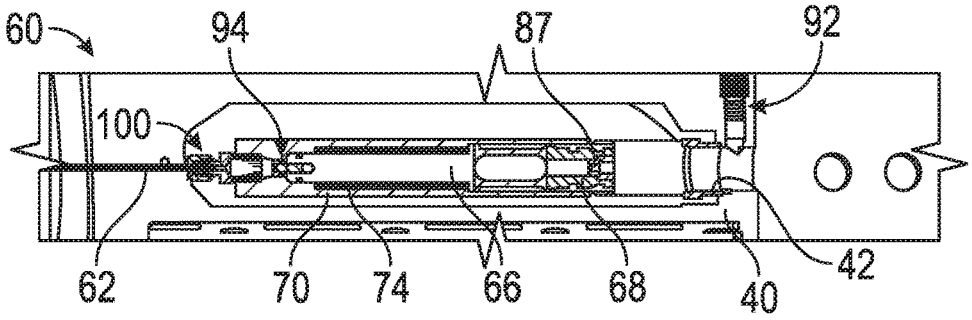
FIG. 10A is a cross-sectional illustration of another embodiment of the valve assembly, according to an embodiment of the disclosure.
Figure 10B:
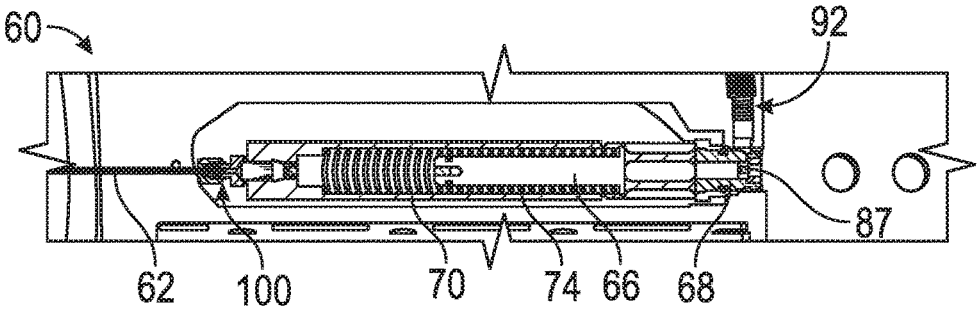
FIG. 10B is a cross-sectional illustration similar to that of FIG. 10A but showing the valve assembly in a different operational position, according to an embodiment of the disclosure.
Figure 10C:
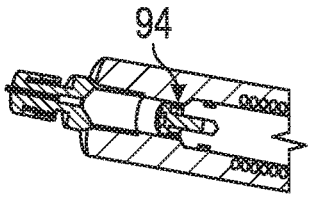
FIG. 10C is an enlarged illustration of an example of a retainer mechanism which may be used in the valve assembly illustrated in FIG. 10A, according to an embodiment of the disclosure.
Figure 10D:
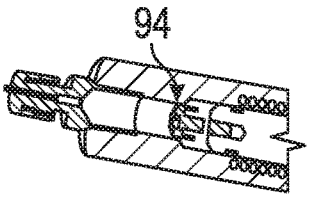
FIG. 10D is an illustration similar to that of FIG. 10C but after release of the retainer mechanism, according to an embodiment of the disclosure.
Figure 11A:
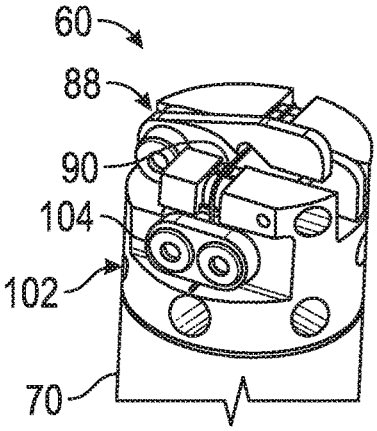
FIG. 11A is an illustration of another embodiment of the valve assembly having a backup triggering system for actuating the valve assembly, according to an embodiment of the disclosure.
Figure 11B:
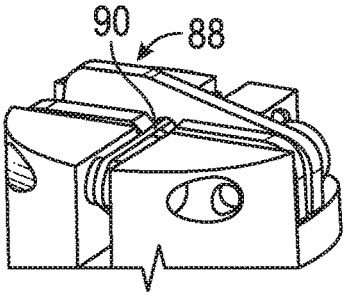
FIG. 11B is an illustration of the backup triggering system from a different angle, according to an embodiment of the disclosure.
Figure 11C:
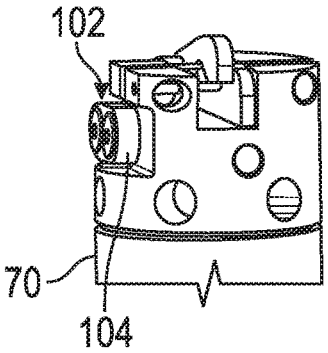
FIG. 11C is an illustration of the backup triggering system from a different angle, according to an embodiment of the disclosure.
Figure 11D:
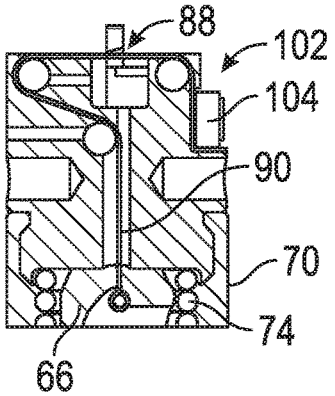
FIG. 11D is a cross-sectional illustration of the backup triggering system for actuating the valve assembly, according to an embodiment of the disclosure.

A similar embodiment of valve assembly 60 may include spring 74 so as to facilitate shifting of the dart 66 and ICD 68 into engagement with corresponding passage 42, as illustrated in FIG. 9 and FIGS. 10A-10B. The retainer 94/tension bolt 96 may again be used to secure dart 66 at a retracted position within structure 70. In this embodiment, the dart 66 may again be formed as a piston forming a seal with a corresponding interior surface of structure 70. When the pressure signal, e.g. a sufficient pressure level, is provided through flow line 62, the retainer 94 is released, e.g. tension bolt 96 is fractured, and dart 66 is released, as further illustrated in FIGS. 10C-10D. Pressurized fluid may be used in cooperation with spring 74 to shift dart 66 linearly into engagement with the corresponding passage 42. Locking mechanism 92 may again be used to secure the dart 66 and ICD 68 in this engaged position.

Referring generally to FIGS. 11A-11D, an embodiment of valve assembly 60 is illustrated with a backup trigger mechanism 102. The backup trigger mechanism 102 may be used with a variety of primary triggers which are actuated via a pressure signal provided in the shunt tubes system 48. In the example illustrated, the backup trigger mechanism 102 is used in combination with cutter mechanism 88 which serves as the primary trigger mechanism. If, for example, the cutter mechanism 88 is unable to sever cord 90 or otherwise release dart 66, the secondary or backup trigger mechanism 102 ensures that dart 66 is able to transition into engagement with the corresponding passage 42.

In the specific example illustrated, backup trigger mechanism 102 comprises a dissolvable clamping block 104. The dissolvable clamping block 104 is constructed from material which dissolves over time in the presence of fluids found in or directed into wellbore 22. If the primary cutter mechanism 88 is unable to sever cord 90 and release dart 66, the dissolvable clamping block 104 continues to dissolve until cord 90 is released. For example, the cord 90 may be clamped between block 104 and an adjacent structure or the cord 90 may be tied to or otherwise secured within dissolvable clamping block 104. Once block 104 dissolves, the cord 90 is released and dart 66 is transitioned into engagement with the corresponding passage 42.

Figure 12:
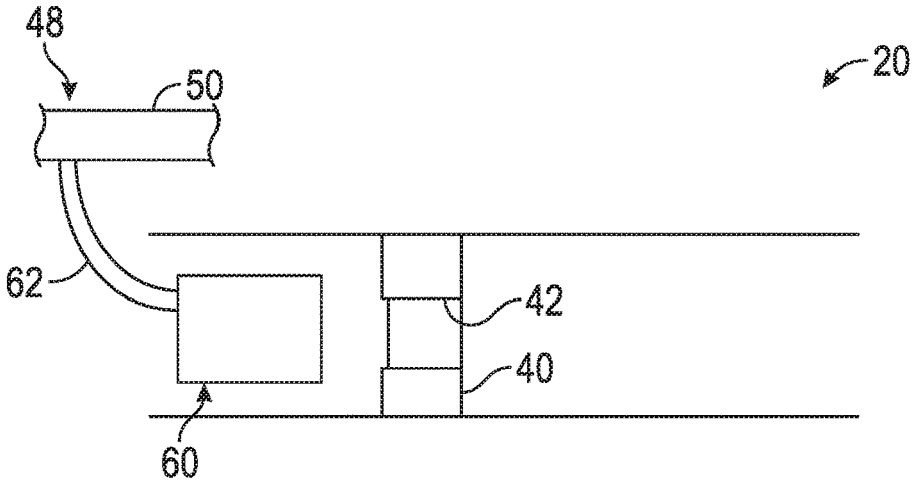
FIG. 12 is a schematic illustration showing another application of the valve assembly, according to an embodiment of the disclosure.

It should be noted the valve assembly 60 may be selectively actuated via the appropriate pressure signal provided in shunt tube system 48 in many types of applications. As illustrated schematically in FIG. 12, for example, the bulkhead 40 may be located in a variety of positions along many types of well completion systems 20 so as to provide desired fluid flow control through various sections of the well completion system 20. The valve member 66, e.g. dart 66, may be used with various ICDs 68 and/or other tools to provide a desired valving and to thus control fluid flow. In some embodiments (see FIG. 17 below), the dart 66 is used to plug passage 42 and the ICD 68 comprises a nozzle or other suitable flow control device disposed through, for example, the wall forming base pipe 26.

Figure 13:
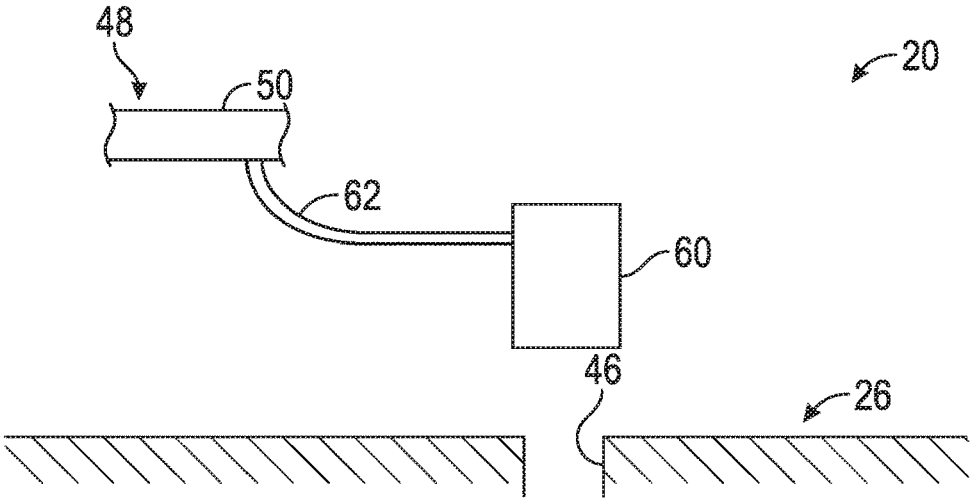
FIG. 13 is a schematic illustration showing another application of the valve assembly, according to an embodiment of the disclosure.

Depending on the application, the valve assembly 60 may be actuated via shunt tube system supplied pressure signals for opening fluid flow, closing fluid flow, or providing desired restrictions on fluid flow. In some applications, the valve assembly 60 may be positioned to change flow through one or more openings 46 formed directly through base pipe 26, as illustrated in FIG. 13. Accordingly, various types of valve assemblies 60 may be operatively coupled with the shunt tube system 48 for actuation via various types of pressure signals provided via shunt tube system 48.

Figure 14:
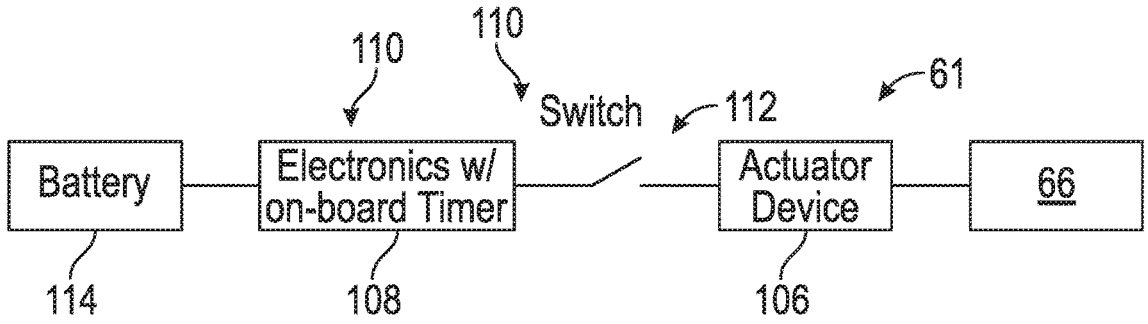
FIG. 14 is a schematic illustration showing another embodiment of an actuator system of the valve assembly, according to an embodiment of the disclosure.

Referring generally to FIG. 14, a schematic representation of another embodiment of valve assembly 60 is illustrated. In this embodiment, the valve assembly 60 is not actuated via a pressure signal but by another type of suitable signal. For example, the valve assembly 60 may be actuated via an electric signal, such as a timed electric signal. The timer-based activation enables the valve assembly 60 to be held in the open flow position to facilitate dehydration of the gravel pack during a gravel packing operation. However, the valve assembly 60 is automatically shifted to the restricted production flow position upon passage of a predetermined period of time.

By way of example, the actuator system 61 of valve assembly 60 may comprise an actuator device 106 coupled with a timer 108 and corresponding electronics 110, including a switch 112. A battery 114 or other suitable power source may be used to power the timer 108 and corresponding electronics 110. The predetermined period of time may be controlled by timer 108 and may be set to exceed the length of time for properly placing the gravel pack but not so long as to exceed the life of battery 114. When the timer 108 has counted to a pre-determined setting, the electronics 110, e.g. on-board electronics, closes switch 112 coupled with actuator device 106. When the switch 112 is closed, an electrical signal, e.g. an electrical power signal, is able to communicate with the actuator device 106 and cause it to actuate. By way of example, the actuator device 106 may be used to enable actuation of a piston coupled with the valve member 66.

Figure 15:
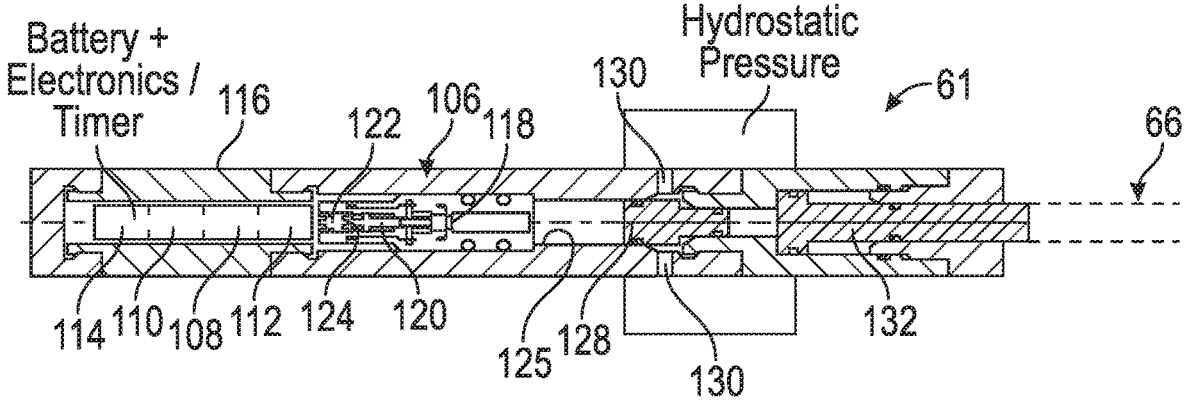
FIG. 15 is a cross-sectional illustration showing another embodiment of an actuator system usable in various embodiments of the valve assembly, according to an embodiment of the disclosure.
Figure 16:
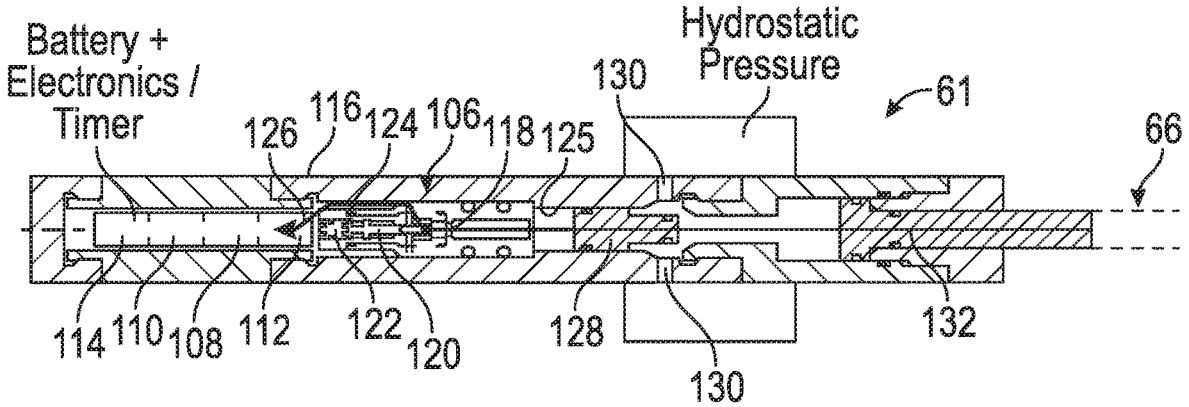
FIG. 16 is a cross-sectional illustration similar to that of FIG. 15 but showing the actuator system in a different operational position, according to an embodiment of the disclosure.

Referring generally to FIGS. 15 and 16, an example is illustrated of an actuator system 61 utilizing a timed electric signal to initiate actuation of the valve assembly 60. In this embodiment, the actuator device 106, timer 108, electronics 110, switch 112, and battery 114 are disposed in a housing 116. By way of example, the actuator device 106 may be in the form of an ERD having a rupture member 118, e.g. a rupture disc, which is ruptured upon impact by a corresponding rupture piston 120. The rupture piston 120 is moved into rupturing engagement with the rupture member 118 in response to a timed electric signal received upon the closing of switch 112. In other words, timer 108 and electronics 110 cause the closing of switch 112 after passage of a predetermined time period.

In this example, the closing of switch 112 in response to input from timer 108 and electronics 110 causes ignition of a propellant 122 in a chamber 124 enclosing rupture piston 120. The resulting pressure acting against rupture piston 120 drives the rupture piston 120 into rupturing engagement with the corresponding rupture member 118. Once the rupture member 118 is ruptured, fluid in an adjacent chamber 125 of housing 116 is allowed to pass through the actuator device 106, as represented by arrow 126. This allows a first piston 128 located in chamber 125 to shift due to the hydrostatic pressure surrounding housing 116, as illustrated in FIG. 16.

The hydrostatic pressure drives external fluid into chamber 125 via one or more ports 130 extending through housing 116. Once the first piston 128 is sufficiently shifted, the inflowing fluid is able to shift a secondary piston 132 which may be coupled with valve member 66. Thus, the timed electric signal may be used to initiate actuation of the valve assembly 60 to the reduced flow configuration for subsequent production. It should be noted, the actuator device 106 may have a variety of configurations and actuation mechanisms which are actuated in response to the timed electric signal or other suitable signal.

Figure 17:
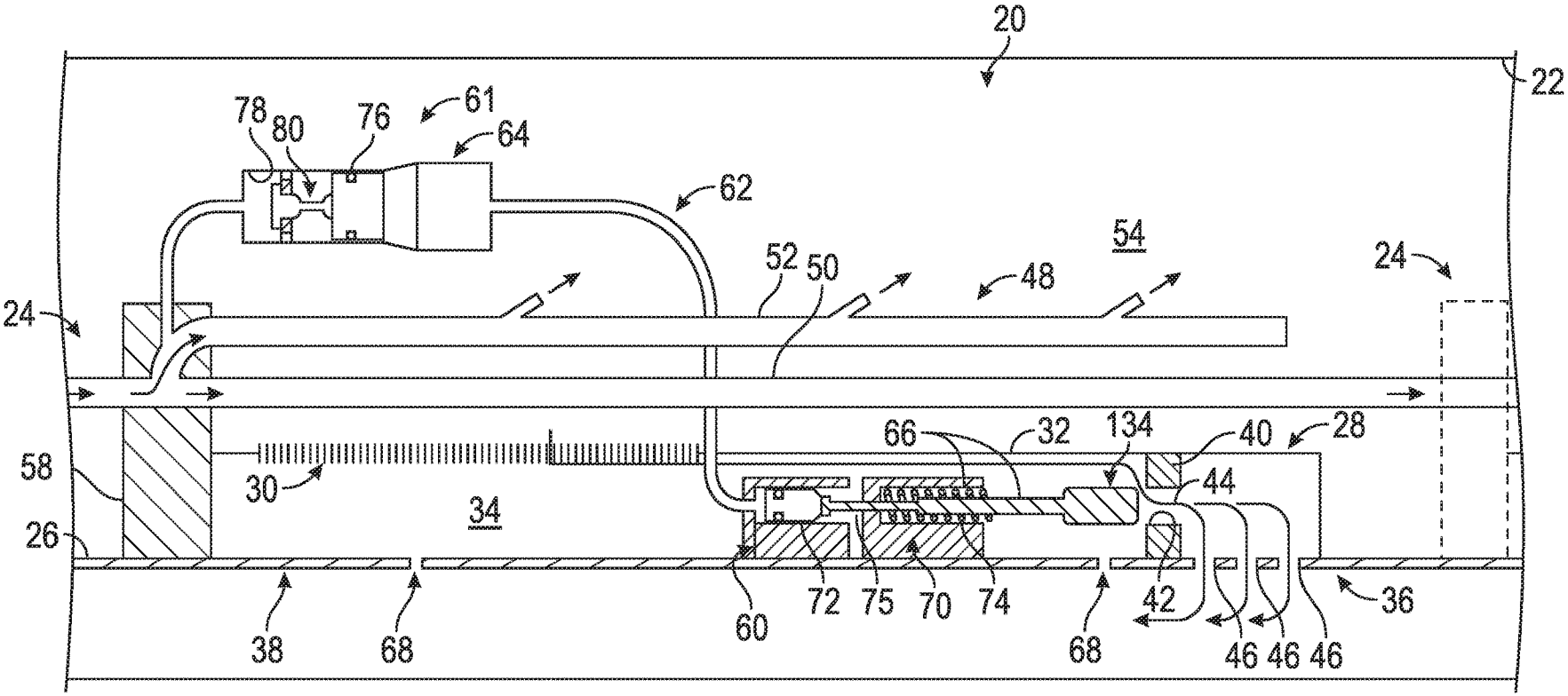
FIG. 17 is a schematic illustration of another example of a completion system deployed in a wellbore, according to an embodiment of the disclosure.

Referring generally to FIG. 17, another embodiment of valve assembly 60 is illustrated as combined into a corresponding screen assembly 24. In this embodiment, valve assembly 60 is again positioned in cooperation with a corresponding passage 42. As with other embodiments described herein, each valve assembly 60 may be actuated between positions via a suitable actuator system 61. The actuation system 61 similarly actuates in response to a suitable signal which may be in the form of a pressure signal, a timed electrical signal, or another suitable signal as described above.

Additionally, each valve assembly 60 comprises valve member/dart 66 oriented for selective engagement with the corresponding passage 42. However, the dart 66 comprises a plug member 134 positioned to engage, e.g. sealably engaged, bulkhead 40 at corresponding passage 42. The plug member 134 serves to block flow through passage 42. However, a separate ICD 68 (or a plurality of ICDs 68) may be positioned to enable production flow to the interior of base pipe 26. As illustrated, the ICD(s) 68 may comprise a nozzle, bore, or other suitable device for enabling a controlled flow from the exterior of base pipe 26 to the interior of base pipe 26 once valve assembly 60 has been actuated to block flow through passage 42 via plug member 134.

Figure 18A:
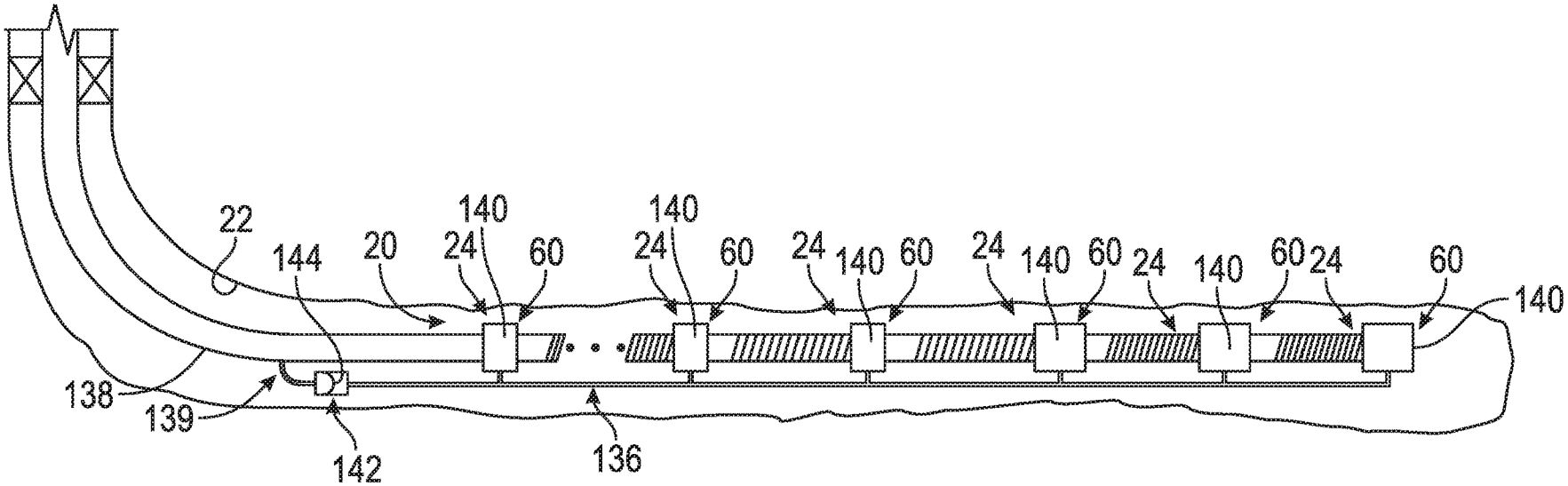
FIG. 18A is a schematic illustration of another example of a completion system deployed in a wellbore, according to an embodiment of the disclosure.
Figure 18B:
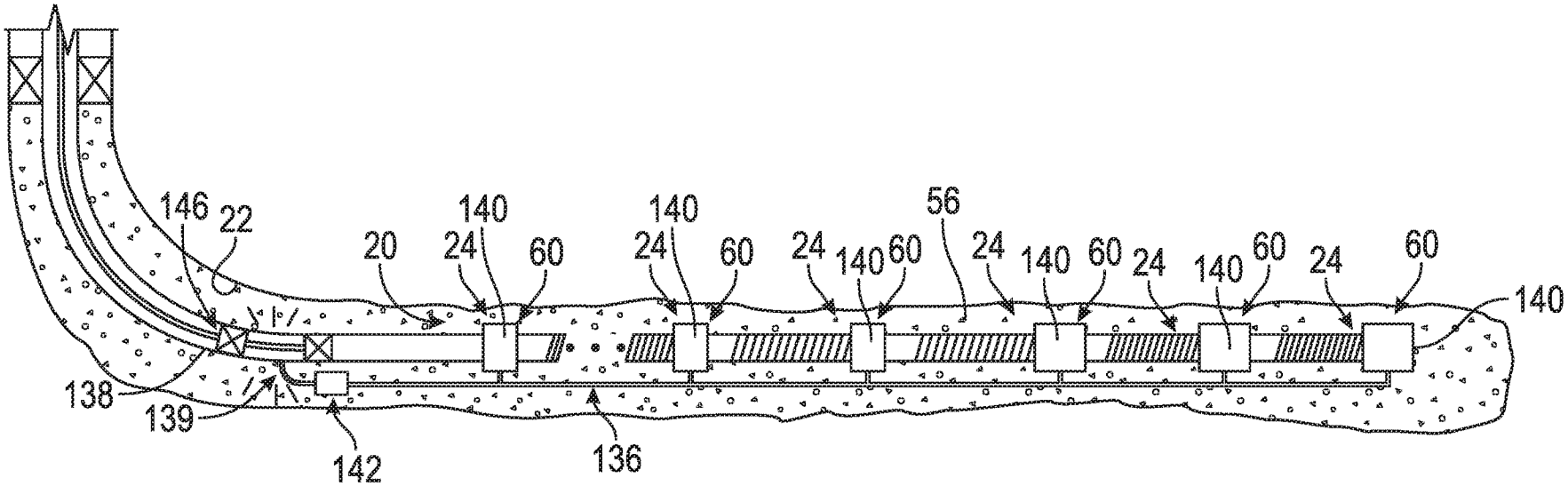
FIG. 18B is a schematic illustration similar to that of FIG. 18A but in a different operational position, according to an embodiment of the disclosure.

Referring generally to FIGS. 18A and 18B, another example of a completion system 20 is illustrated as deployed in a wellbore 22. In this example, completion system 20 again comprises screen assemblies 24 each associated with base pipe 26 and corresponding valve assembly 60. However, this embodiment of completion system 20 does not employ an alternate path system such as the shunt tube system 48 described above. The valve assemblies 60 may be actuated via various types of actuator systems 61, as described above, in response to a suitable signal such as a pressure signal or timed electric signal.

According to an embodiment, the valve assemblies 60 associated with corresponding screen assemblies 24 are connected to a pressure control line 136. The pressure control line 136 may be ported into production tubing 138 at a port location 139. The production tubing 138 is in fluid communication with the base pipe or pipes 26 positioned within screen assemblies 24. The pressure control line 136 also may be ported to each valve assembly 60. By way of example, each valve assembly 60 may have a surrounding dart housing 140, and the pressure control line 136 may be ported into the dart housings 140 and ultimately into fluid communication with piston 72 or other suitable actuating component.

In some embodiments, a pressure release device 142 may be positioned along the pressure control line 136 between valve assemblies 60 and production tubing 138. By way of example, the pressure release device 142 may comprise a burst member 144, e.g. a burst disc. To rupture the burst member 144, sufficient pressure may be applied within production tubing 138 to cause fracture of the burst member and activation of the valve assemblies 60.

According to one embodiment, a straddle packer 146 may be moved downhole within production tubing 138 until it straddles port/location 139. A suitable rupture pressure may then be applied from the surface until the burst member 144 is fractured. As a result, a pressure signal in the form of increased pressure travels through pressure control line 136 and may be used to activate the valve assembly 60. By way of example, the pressure signal in pressure control line 136 may be used to shift darts 66 (and the corresponding ICD 68 or plug member 134) into flow restricting engagement with corresponding passages 42.

It should be noted, however, this type of system also may utilize timed electric signals or other suitable signals to cause controlled actuation valve assemblies 60 in completion systems which do not utilize alternate path systems. By way of example, these types of systems may be employed to perform high rate alpha-beta gravel packs with completion systems utilizing ICDs but without alternative path systems. Additionally, these types of systems may be used as back-up systems with various completion systems 20, including alternate path type completions.

The components and configuration of completion systems 20 may be changed to accommodate several gravel packing and production applications. Similarly, the components and configuration of the shunt tube system 48, valve assembly 60, actuator system 61, and pressure release mechanism 64 may be changed according to parameters of a given application. By way of example, the actuator system 61 may act in response to pressure signals, timed electric signals, or other suitable signals. For example, the actuator system 61 may comprise an electric rupture disc or other electronic release device which may be configured to electronically respond to other inputs, e.g. electrical inputs from a built in timer.

Actuator systems 61 also may be constructed to enable actuation of the pressure release mechanism 64 according to pressure signals in the form of various pressure inputs. By way of example, actuation pressures used to enable communication of pressure through pressure release mechanism 64 may be in the range from 200 psi through 2500 psi or even higher. The pressure signals also may comprise various pressure pulses/patterns applied to actuator system 61 to cause actuation of valve assembly 60.

Additionally, the valve assembly 60 may utilize various types of valve members 66, e.g. darts or other mechanisms, which may be selectively shifted to provide fluid flow control. As discussed above, various types of valve members 66 may comprise ICDs 68 or plugs 134 of various sizes and configurations to provide desired fluid flow patterns before and after actuation of valve assembly 60. For example, the ICD 68 may have a nose protrusion with a seal, e.g. an O-ring, disposed on its outside diameter for sealing insertion into the corresponding passage 42. The ICD 68 also may comprise nozzle 87 disposed along an inside diameter of the nose protrusion and in communication with radial holes in a wall of dart 66 to provide a flow path to and through the nozzle 87. Such ICDs 68 may be used as part of the dart 66 or within the wall forming base pipe 26 depending on the configuration of the valve assemblies 60.

The nozzle 87 may be sized to provide a desired choking of the production fluid flow as production fluid flows through filter section 30, along annulus 34, through the radial holes in dart 66, and then through the ICD nozzle 87. If the dart 66 employees plug 134, the nozzle 87 may be disposed within the wall forming base pipe 26. Following passage through nozzle 87, the production flow is able to move to an interior of the base pipe 26 for production to a surface location or other desired location. However, the structure of valve member 66 and/or overall valve assembly 60 may be changed to accommodate various flow control applications.

In fact, some embodiments may utilize dart 66 or another suitable operator which is moved in a non-linear motion to provide a desired valve control over fluid flow. Various pressure levels and/or other pressure signals also may be provided in shunt tube system 48 and through flow line 62 for actuation of the valve assembly 60 between different operational positions.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a completion system having a screen assembly sized for deployment in a wellbore, the screen assembly comprising:

a tubular member having a filter section and a non-permeable section;

a base pipe disposed within the tubular member and creating an annulus therebetween, the base pipe having a perforated base pipe section radially inward of the non-permeable section and a non-perforated base pipe section radially inward of the filter section;

a bulkhead extending between the base pipe and the tubular member at a location dividing the perforated base pipe section and the non-perforated base pipe section, the bulkhead having a passage therethrough of sufficient size to allow enough flow to the perforated base pipe section so as to avoid substantial pressure loss during gravel packing; and a valve assembly positioned in cooperation with the passage for selectively restricting flow through the passage, the valve assembly being actuatable via a signal applied to an actuator system of the valve assembly, wherein the completion system comprises a shunt tube system deployed externally of the tubular member, and wherein the valve assembly is coupled with a flow line extending to the shunt tube system, the valve assembly being actuatable via a pressure signal, the valve assembly comprising a dart oriented for selective engagement with the passage once the valve assembly is actuated via the pressure signal applied via the flow line, thus restricting flow through the bulkhead and through the perforated section of the base pipe.

2. The system as recited in claim 1, wherein the completion system comprises a plurality of screen assemblies.

3. The system as recited in claim 1, wherein the dart comprises an inflow control device (ICD).

4. The system as recited in claim 1, wherein the dart comprises a plug member positioned to plug the passage once the valve assembly is actuated.

5. The system as recited in claim 1, wherein the dart is moved into engagement with the passage via a spring upon application of sufficient pressure in the shunt tube system to cause release of the dart.

6. The system as recited in claim 1, wherein the dart is moved into engagement with the passage via application of sufficient pressure in the shunt tube system to cause release of the dart and then to shift the dart.

7. The system as recited in claim 1, wherein the valve assembly is actuatable via an electric signal applied to the actuator system.

8. The system as recited in claim 1, wherein the completion system comprises a backup actuation system.

9. The system as recited in claim 1, wherein the valve assembly comprises a lock mechanism.

10. The system as recited in claim 1, wherein the passage comprises a plurality of passages and the valve assembly comprises a plurality of darts corresponding with the plurality of passages.

11. A system, comprising:

a completion system having:

a screen assembly sized for deployment in a borehole, the screen assembly comprising a tubular member having a filter section and a base pipe disposed in the tubular member; and a valve assembly positioned to control a fluid flow through a passage disposed within the screen assembly, the valve assembly being actuatable via a signal so as to change flow into the base pipe from a higher rate during a gravel packing operation to a lower rate during a subsequent production operation, wherein the completion system comprises a shunt tube system deployed externally of the tubular member, and wherein the signal comprises a pressure signal applied through the shunt tube system.

12. The system as recited in claim 11, wherein the valve assembly comprises a dart having an ICD which is selectively movable into the passage to reduce flow therethrough.

13. The system as recited in claim 11, wherein the valve assembly comprises a dart having a plug member which is selectively movable into the passage to block flow therethrough and to thus force a production flow through an ICD mounted in the base pipe.

14. The system as recited in claim 11, wherein the signal comprises a timed, electrical signal.

15. The system as recited in claim 11, wherein the signal comprises a pressure signal.

16. A method, comprising:

providing a well completion with a shunt tube system to facilitate a gravel packing operation;

enabling a gravel pack carrier fluid to return through a base pipe of the well completion;

positioning a valve assembly to restrict fluid flow into the base pipe following the gravel packing operation; and selectively actuating the valve assembly, via a signal, to restrict fluid flow into the base pipe, wherein the signal comprises a pressure signal applied through the shunt tube system, and wherein selectively actuating comprises actuating a pressure release mechanism to enable flow of the pressure signal from the shunt tube system to the valve assembly.

* * * * *